United States Patent [19]

Choquette

[11] Patent Number: 4,565,161

[45] Date of Patent: Jan. 21, 1986

[54] STEAM GENERATION

[75] Inventor: Andre Choquette, Ste-Thérèse, Canada

[73] Assignee: Uraken Canada Limited, St-Eustache, Canada

[21] Appl. No.: 721,154

[22] Filed: Apr. 8, 1985

[51] Int. Cl.[4] ..... F22B 1/02

[52] U.S. Cl. ..... 122/32; 62/238.6; 62/238.7; 122/40

[58] Field of Search ..... 122/31 R, 32, 40, 4 R; 62/238.6, 238.7

[56] References Cited

U.S. PATENT DOCUMENTS 2,952,138 9/1960 Russell et al. .
3,533,231 10/1970 Lacy ..... 122/40 X
4,093,868 6/1978 Manning .
4,177,651 12/1979 McFarland .
4,256,059 3/1981 Roggow et al. ..... 122/32

*Primary Examiner*—Edward G. Favors
*Attorney, Agent, or Firm*—Robic, Robic & Associates

[57] ABSTRACT

A tank contains water heated by a heat pump having a heat exchanger part in a waste-water reservoir or in a waste air conduit and a further heat exchanger part in the water of the tank, heat being picked up in the reservoir or conduit and delivered to the water in the tank. The latter is a closed tank and the space above the water is connected to the inlet of a motor-driven centrifugal turbine. The lower pressure thus formed above the level of the water by the turbine inlet causes evaporation of the water and the turbine compresses this vapor into pressurized steam.

9 Claims, 1 Drawing Figure

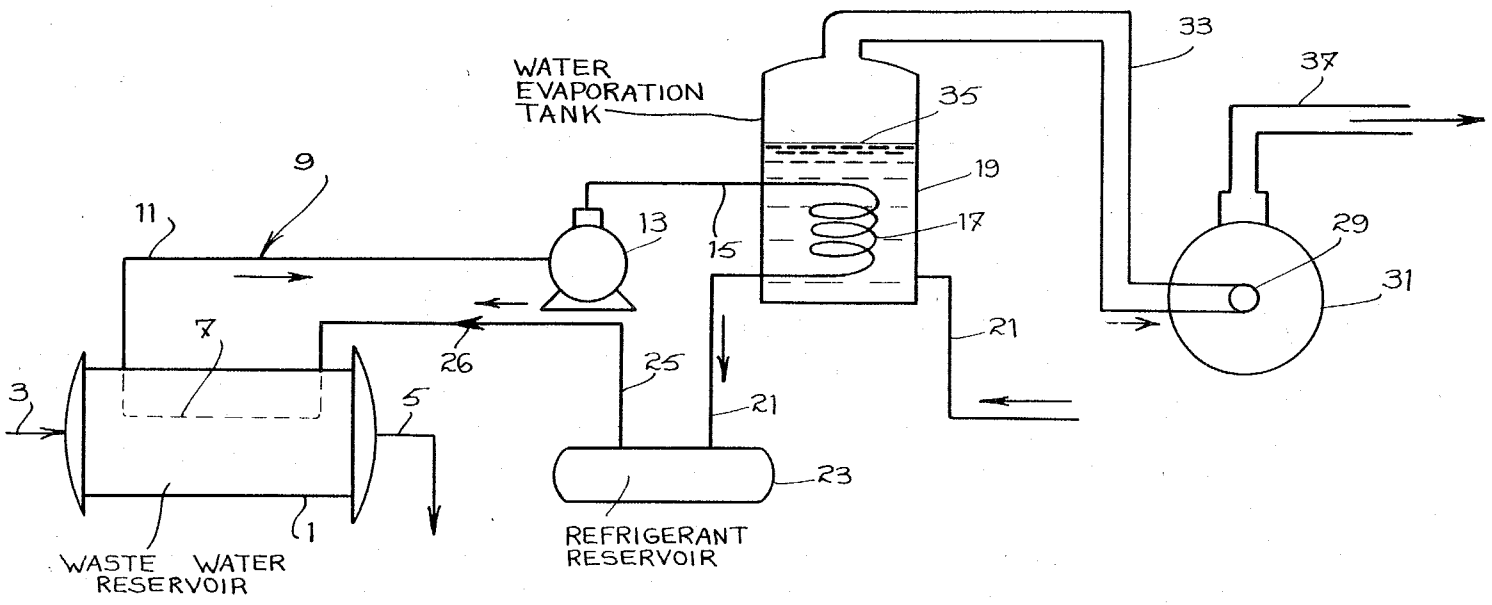
WATER EVAPORATION TANK
REFRIGERANT RESERVOIR
WASTE WATER RESERVOIR
1
3
5
7
9
11
13
15
17
19
21
23
25
26
29
31
33
35
37

STEAM GENERATION

The present invention relates to steam generation and more particularly to a method and to an installation for producing steam under pressure, suitable for heating and for industrial processes, wherein a portion of the necessary heat energy for producing the steam is recuperated from low temperature waste materials, typically industrial waste water or waste hot air.

Several attempts have been made and much research work done recently to develop an appropriate heat pump suitable for generating steam under pressure. The use of a heat pump for such a purpose would be particularly attractive because heat pumps are readily available on the market and are used in industry for various purposes such as heating industrial substances. The difficulty with them is that the working fluid, or refrigerant, of the pump cannot be raised to a temperature sufficient to heat water into sufficiently pressurized steam. Efforts to develop an adequate pump have so far been unsuccessful mainly because no practical working fluid is available. Methanol would be such a fluid but because it is difficult and dangerous to handle, it must be absolutely discarded. The refrigerants presently used in heat pumps are of the fluorinated hydrocarbon type, known as freons, that cannot be brought to a temperature higher than 200° F., possibly 220° F., which is not high enough for generating steam intended for heating or industrial processes. Such a steam requires pressures generally in the range of 10 to 100 psig.

There were also other technological limitations that prevented the development of a heat pump capable of being used for generating steam, such limitations being particularly related to the type of lubricants to be used.

On the other hand, several industries have installations using centrifugal turbines, called MVR for mechanical vapor recompression, which are used for boosting the pressure of steam by compressing it but which are not used for producing steam under pressure from an evaporating liquid, typically water.

It is an object of the present invention to provide a method and an installation based on the above two technologies and that are combined to be suitable for the production of steam under pressure capable of being used for heating or for industrial processes where most steam pressures range from 10 to 100 psig, as aforesaid, with corresponding saturated temperature ranging from 240° to 338° F.

The basic idea of the invention lies in heating, in a closed container, a pool of water to around 200° F., and this can be done well with a conventional heat pump; then lower the pressure above the pool of water whereby to lower the boiling point of the water and cause it to evaporate rapidly and, finally, compress the vapor thus formed to produce the desired steam under pressure. The compression of the vapor can be done by hooking the inlet of a motor-driven turbine, appropriately a centrifugal turbine, to cause a suction in the closed tank, creating the required vapor, and then draw the steam under pressure, at the outlet of the turbine.

Accordingly, the present invention as broadly claimed herein is concerned with a method of generating steam comprising the steps of: providing a closed evaporation tank; feeding water into the tank to form a pool having an evaporation level; withdrawing heat from a heat source and heating the pool water therewith to a temperature below the temperature, at a working pressure, of the pool water; lowering the pressure, in the tank, over the level of the pool water, to cause evaporation of the pool water into vapor at a pressure lower than the working pressure, and mechanically pressurizing the vapor to turn it into pressurized steam.

The invention as also broadly claimed herein is concerned with a steam generating installation comprising: a closed tank; means for feeding water into the tank to form a pool having an evaporation level; means for heating the water in the tank to a temperature below the boiling temperature, at a working pressure, of the pool water; mechanical means for lowering the pressure in the tank over the evaporation level for, on the one hand, evaporating the pool water into vapor at a pressure lower than the wirking pressure and, on the other hand, pressurizing the vapor to turn it into pressurized steam.

A description of a preferred embodiment of the invention is given hereinafter having reference to the appended drawing including a single FIGURE illustrating, diametrically, a steam generating installation according to the present invention.

Shown to the left of the FIGURE is a heat pump circuit which includes a reservoir 1 into which is fed, at 3, waste water at a temperature ranging from 60° to 160° F., the cooled waste water being discharged at 5. A first heat-exchanger part 7 of a heat pump 9 is installed in the waste water of the reservoir 1. Feed piping 11 of the heat pump 9 connects the first heat-exchanger part 7 to the inlet of a compressor 13 of which the outlet is connected by means of a further feed piping 15 to a second heat-exchanger part in the form of a condenser coil 17 located within a closed evaporation tank 19. The lower end of the condensor coil 17 is connected by a return piping 21 to a refrigerant or working fluid reservoir 23. A return piping 25 inter-connects the working fluid reservoir 23 and the first heat-exchanger part 7, a throttling device 26 being mounted across the return piping 25. This completes the fluid flow circuit of the heat pump 9.

Water is fed into the evaporation tank 19 by a piping 27 advantageously carrying steam condensate from the heating system or other industrial process system.

This heat pumping system 9 is well known as well as its operation which will only be described very briefly.

At the lowest pressure and temperature in the heat pump cycle, the working liquid or refrigerant flowing in the first heat-exchanger part 7 absorbs heat from the hot waste water in the tank 1 and in so doing it evaporates from a liquid to a gas which is led, through piping 11, to the inlet of the compressor 13. Since the working liquid evaporates in the reservoir 1, the latter is appropriately usually called an evaporator. The gas is then compressed to a higher pressure and temperature by the motor driven compressor 13, which motor can of course be either electric or other type. The compressor 13 compresses the gas to a pressure which must correspond to a temperature greater than the temperature of the liquid in the evaporation tank 19 to which water, coming from the condensate piping 27, heat is transferred. The working gas is condensed in the coil 17 as it delivers its thermal energy to the water in the tank 19. The liquified working fluid returns to the reservoir 23 and out thereof through the return piping 25 where, in the throttling device 26, part of the liquid flashes and the temperature drops to the temperature at which it can absorb the waste heat in the waste water of the reservoir 1.

Merely as an example, the temperature of the working liquid at the outlet of the throttle 26 would be 50° F. and would raise, in gaseous form, to 100° F. at the outlet of the evaporator tank 1, in the feed piping 11. Coming out of the compressor, still in gaseous form, the temperature would be about 200° F. of saturated discharge temperature and it is, with presently heat pumps, about the highest temperature that can be reached, if it is taken that the temperature of the waste water entering the evaporation tank 1 through the feed pipe 3 is between 60° to 160° F.

The evaporation tank 19, according to the invention, is a closed tank of which the top is connected to the inlet 29 of a motor driven turbine 31, appropriately of the centrifugal type, the connection being by means of a piping connection 33. Thus, as the motor driven turbine 31 is operated, a vacuum is formed within the tank 19, above the water level 35, such as to lower the boiling temperature of the water in the tank 19. Evaporation thus takes place in the tank 19 and the vapor is drawn into the turbine 31 where it is compressed into steam at a pressure above atmospheric pressure. The pressurized steam is then discharged through an outlet conduit 37. By this system, steam can be obtained with a pressure range of 10 to 100 psig corresponding to a saturated temperature range of about 240° to 338° F. This range will usually satisfy current needs of industry using heating and process steam and will advantageously recuperate heat from waste water that would normally go to drain.

I claim:

1. Method of generating steam comprising:

providing a closed evaporation tank;

feeding water into said tank to form a pool having an evaporation level;

withdrawing heat from a heat source and heating said pool water therewith to a temperature below the boiling temperature, at a working pressure, of said pool water;

lowering the pressure, in said tank, over said level of said water pool, to cause evaporation of said pool water into vapor at a pressure lower than the working pressure, and mechanically pressurizing said vapor to turn it into pressurized steam.

2. A method as claimed in claim 1, wherein said heat source is a source of waste air or water, and comprising heat-pumping said waste air or water for withdrawing heat therefrom for heating said pool water.

3. A method as claimed in claim 1, wherein said vapor is mechanically pressurized by a motor-driven turbine.

4. A method as claimed in claim 3, wherein said heat source is a source of waste air or water, and comprising heat-pumping said waste air or water for withdrawing heat therefrom for heating said pool water.

5. A method as claimed in claim 1, comprising using as said feeding water, condensate resulting from said pressurized steam.

6. A steam generating installation, comprising:

a closed tank;

means for feeding water into said tank to form a pool having an evaporation level;

means for heating said water in said tank to a temperature below the boiling temperature, at a working pressure, of said pool water;

mechanical means for lowering the pressure in said tank, over said evaporation level for, on the one hand, evaporating said pool water into vapor at a pressure lower than said working pressure and, on the other hand, pressurizing said vapor to turn it into pressurized steam.

7. An installation as claimed in claim 6, wherein said water heating means comprise: a waste-water container and a heat pump having a first heat exchanger part in said container for collecting heat from said waste water and a second heat exchanger part in said tank water pool for transferring heat, collected in said container, to said pool water.

8. An installation as claimed in claim 6, wherein said mechanical means comprise: a motor-driven turbine having an inlet end and conduit means connecting said inlet end and said closed tank, above said level, to guide said vapor to said turbine, said turbine further having an outlet end for discharging said above-atmospheric pressure steam.

9. An installation as claimed in claim 6, wherein said water heating means comprise: a waste air conduit and a heat pump having a first heat exchanger part in said conduit for collecting heat from said waste air and a second heat exchanger part in said tank water pool for transferring heat, collected in said conduit, to said pool water.

* * * * *